US005427401A

United States Patent [19]

Liard

[11] Patent Number: 5,427,401

[45] Date of Patent: Jun. 27, 1995

[54] SKI HAVING AT LEAST ONE RECESS FORMED IN AN UPPER SURFACE THEREOF

[75] Inventor: Jean Liard, Sallanches, France

[73] Assignee: Skis Rossignol SA, France

[21] Appl. No.: 69,397

[22] Filed: Jun. 1, 1993

[30] Foreign Application Priority Data

Jun. 11, 1992 [FR] France ..... 92 07310

[51] Int. Cl.[6] ..... A63C 5/07; A63C 5/075

[52] U.S. Cl. ..... 280/609; 280/602; 280/607; 280/608; 280/610

[58] Field of Search ..... 280/601, 602, 607, 609, 280/610

[56] References Cited

U.S. PATENT DOCUMENTS

| | | | |
|---|---|---|---|
| 1,998,702 | 4/1935 | Boline | 280/609 |
| 4,848,784 | 7/1989 | Scherubl | 280/602 |
| 4,974,867 | 12/1990 | Rullier et al. | 280/607 |
| 5,141,243 | 8/1992 | Meatto | 280/609 X |
| 5,280,943 | 1/1994 | Commier et al. | 280/609 |

FOREIGN PATENT DOCUMENTS

| | | | |
|---|---|---|---|
| 182660 | 12/1954 | Austria | 280/609 |
| 804598 | 10/1936 | France | 280/609 |
| 2583296 | 12/1986 | France . | |
| 2664172 | 1/1992 | France . | |
| 435061 | 10/1926 | Germany . | |
| 1235307 | 6/1992 | Italy . | |
| 52-6239 | 1/1977 | Japan . | |
| 622430 | 4/1981 | Switzerland . | |
| WO88/01190 | 2/1988 | WIPO . | |

*Primary Examiner*—Brian L. Johnson
*Attorney, Agent, or Firm*—Parkhurst, Wendel & Rossi

[57] ABSTRACT

A ski including a running sole (17) and a metal edge (18), whose lateral ridges are connected to the upper surface (3) of the ski by lateral side walls (2). On the upper face (3) and in front and/or behind the central zone of the support face (8), at least one recess (9, 10) extends, whose depth decreases from the zone of the support face in the direction of the two ends (4, 5) of the ski.

20 Claims, 5 Drawing Sheets

SKI HAVING AT LEAST ONE RECESS FORMED IN AN UPPER SURFACE THEREOF

BACKGROUND OF THE INVENTION

The invention relates to a ski with improved profile, as is particularly intended for the practice of winter sports, and more particularly for alpine skiing.

As is known, skis consist of a running sole, intended to be in direct contact with the snow or ice, and whose lateral borders are fitted with metal edges, themselves connected to the upper face of the ski by lateral portions termed side walls. The side walls maybe vertical or inclined.

Traditionally, skis are thicker at the support face than at the ends where the ski progressively thins. This greatest thickness is intended on the one hand to allow mounting of the screws of the bindings which hold the shoes of the skier, and on the other hand, and above all, to give this central zone increased rigidity, in order to allow sufficiently widespread distribution of the load induced by the mass of the skier.

Furthermore, in order to give the ski qualities of speed and qualities of response, it is important for its two ends to be relatively flexible and thin.

A ski has for example been proposed in document FR-A-2,664,172 (SALOMON) in which, on the one hand, the zone of the support face has a central rib intended, with adapted shoes, to allow the foot of the user to be brought closer to the edges, in order to improve the effectiveness of setting the edges and, on the other hand, the forward and back zones of the ski, with respect to the central support surface, were lowered at the mid part and raised on the borders in the form of lateral ribs. In this way, it is possible to obtain flexibility of the ends, while preserving the inertial masses improving the dynamic behavior of the ski.

Nevertheless, although it is true that through this procedure the resulting ski has sufficient inertia in its zones uphill and downhill with respect to the support zone, while thereby giving the ski greater flexibility, and, thereby promoting bending of the ski and therefore rounding of the turn, on the other hand, such a configuration is observed to cause a loss in rigidity of the ski, in particular in twisting, which results from bringing the reinforcement elements of the neutral axis of the ski closer to the forward and backward zones. Now, this decreased rigidity produces on the one hand relative weakness of the ski, which can even lead to risks of breakage, and on the other hand the onset of vibrations, with a significant detrimental effect on the behavior of the ski on the snow, in particular making it more difficult to hold the ski in the desired direction. Furthermore, a ski with this configuration requires either the use of specific shoes, including a wide central groove allowing the central rib of the ski to be accommodated, or the use of specific binding plates which are compatible with the presence of the central rib of the ski.

Decreasing the mass of skis currently constitutes an area of great interest to manufacturers, because a ski which is too heavy may hinder the user. In fact, such a ski is difficult to direct, is difficult to handle and gives the skier the impression of being stuck to the snow. In contrast, ends which are too light can generate other undesirable sensations during use, and in particular give the impression that the tips are unsteady, through a lack of steering effect, which can be exhibited by inaccuracies in following a line.

SUMMARY OF THE INVENTION

The object of the invention is to provide a ski overcoming these various drawbacks, by providing a ski of reduced mass, whilst retaining the inertia of the forward and back zones, which is necessary for improving the characteristics of speed and active response of the ski.

Slalom skiing, and more generally skiing on runs in short turns, requires specific qualities. In fact, the skis are then stressed energetically in particular by pronounced setting of the edges, requiring high resistance to lateral bending. In other words, under the effect of a load applied directly into their sides, they must bend laterally and/or twist as little as possible. In fact, untimely lateral deformations unavoidably generate imprecisions in rounding the turns, as well as slipping of the edges, which can possibly cause the skier to fall.

Furthermore, it has been possible to demonstrate that it is possible to alter the performance of a ski by changing the distribution of pressure of the ski on the snow.

The ski according to the invention comprises a running sole fitted with metal edges whose lateral ridges are connected by side walls, which are vertical or inclined with respect to the perpendicular of the sole, to the upper face which is conventionally continuous and smooth, and on the upper face, and in front of and/or behind the central zone of the support face at least one recess extends, whose depth decreases from the zone of the support face to the vicinity of the front and/or rear contact line of the ends of the ski.

This ski comprises, in a known manner, reinforcement elements situated on either side and as far as possible from its neutral axis, and in particular in internal contact with the decorative element on the one side, and the sole on the other side. These reinforcement elements generally consist of a metal alloy base, such as an aluminum and zinc based alloy (ZICRAL—registered trade mark) or of a textile cloth, for example glass fibers, carbon fibers, or alternatively polyaramid fibers (KEVLAR—registered trade mark), possibly preimpregnated with a heat-setting resin. The upper reinforcement element may advantageously have, at its ends, the shape of an inverted omega (Ω), whose loop corresponds to the base of the characteristic recess of the invention, and whose lateral wings allow the resistant to lateral bending of the ski to be significantly increased.

In other words, the invention consists not in altering the conventional zone of the support face, that is to say in retaining the upper surface of the ski without a break or discontinuity, in contrast to skis comprising a projecting plate, but above all in generating ribs on either side of the zone of the support face, and on the two lateral borders of the upper face of the ski, which then have the shape of an inverted Ω, which can give it rigidity in lateral bending, and in torsion, greater than that of skis hitherto known, and thereby promoting the stability of this ski.

According to one embodiment of the invention, the width of the recesses widens from the support face in the direction of the ends.

Advantageously, these ribs decrease in size from the support face to the ends, that is to say, to the contact plane of the ski, defined, in a known manner, as being the planes perpendicular to the sole of the ski passing through the respective front and rear contact lines of the ski.

In a first embodiment, the recesses are symmetrical with respect to a vertical plane passing through the longitudinal midline of the ski. In other embodiments, these recesses have a certain degree of asymmetry, and in particular a variation in depth, the ribs of a same flaring being able to have different sizes, the base of the flaring not necessarily being parallel to the sole.

In one particular case the upper face provided with these recesses is attached and fixed over the entirety of the ski by gluing. In another embodiment, the ski, provided with these two recesses, is obtained directly by molding.

The manner in which the invention may be embodied, and the advantages which stem therefrom will emerge better from the exemplary embodiment which follows, and is given by way of indication, and nonlimitingly with reference to the attached figures.

DETAILED DESCRIPTION OF THE INVENTION

Figure 1:
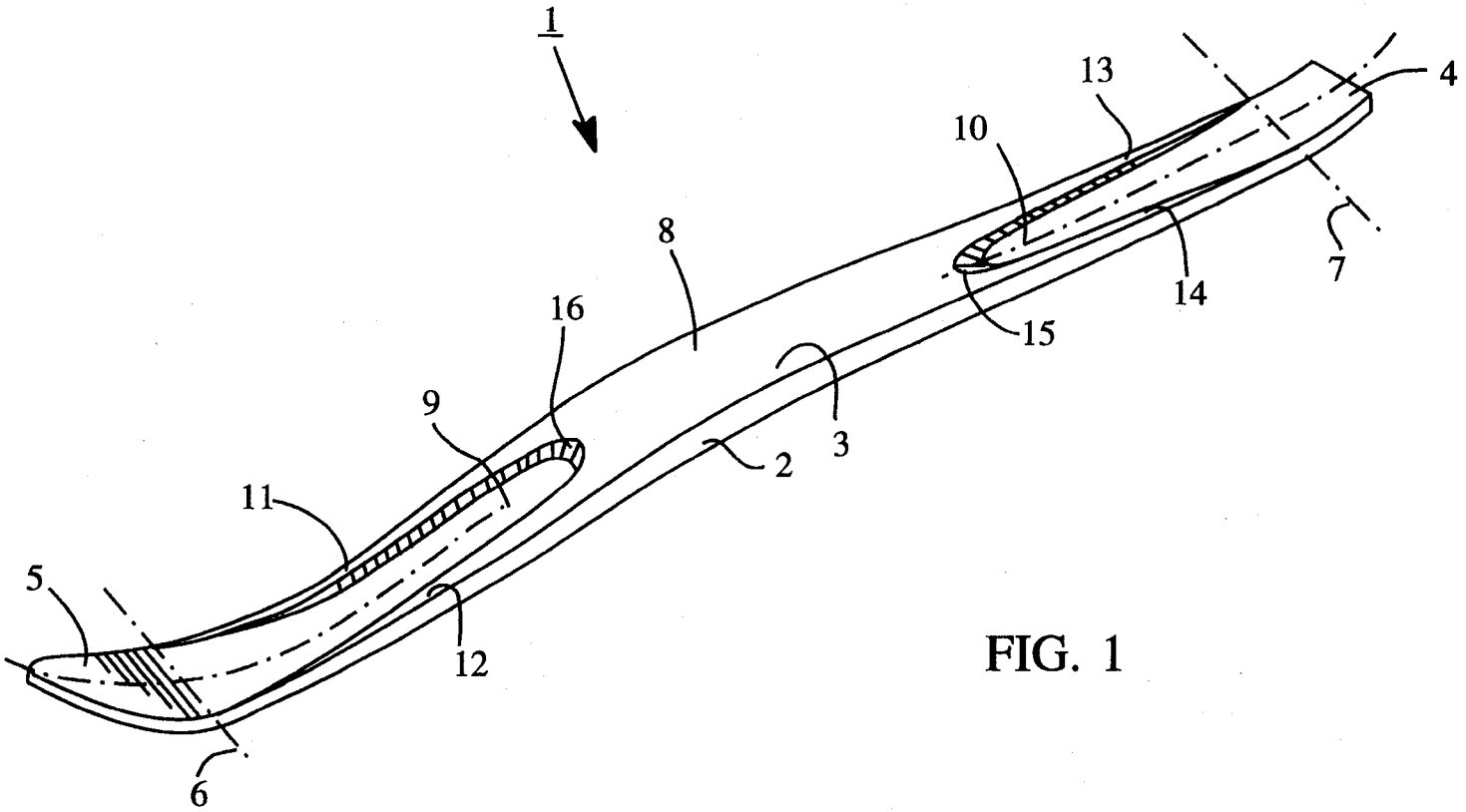
FIG. 1 is a diagrammatic perspective representation of a ski according to the invention.

Referring to FIG. 1, in which a ski in accordance with the invention is represented diagrammatically, and carries the general reference (1), this ski fundamentally consists of a central zone or support face (8) with a thickness greater than the two ends, and typically approximately 20 (twenty) millimeters, and extending over a distance close to 600 (six hundred) millimeters. These two ends respectively consist of the rear end (4) and the tip (5), whose shape curves upwards. Traditionally, the tip and rear end are slightly raised upwards from a line called respectively the front (6) and rear (7) contact line. The thickness of the ski at these two ends is reduced with respect to the support face, and is close to 5 (five) millimeters.

Furthermore, this ski comprises a running sole (17) (FIG. 5), connected to the upper face of the ski (3) by lateral sides (2), which are possibly inclined with respect to the perpendicular of the sole. It is obvious that the invention may also be applied to skis with a rectangular cross section, that is to say with vertical lateral sides.

According to a fundamental characteristic of the invention, the upper face (3) has two recesses, respectively a forward recess (9) and a back recess (10), situated on either side of the zone of the support face (8) and extending as far as the respective vicinities of the planes containing the front (6) and rear (7) contact lines.

As can be seen in FIG. 1, these recesses (9) and (10) widen from the zone of the support face as far as the aforementioned contact planes. Furthermore, they are more "hollowed" in the vicinity (15, 16) of the support face (8) than towards the ends, so that their depth decreases from the zone of the support face to the said contact planes, and generates on the lateral borders of the upper face (3) respectively forward (11) and (12) and back (13) and (14) ribs. These ribs are further visible on the cross sections 5 to 11, which are described in more detail hereinbelow.

Figure 2:
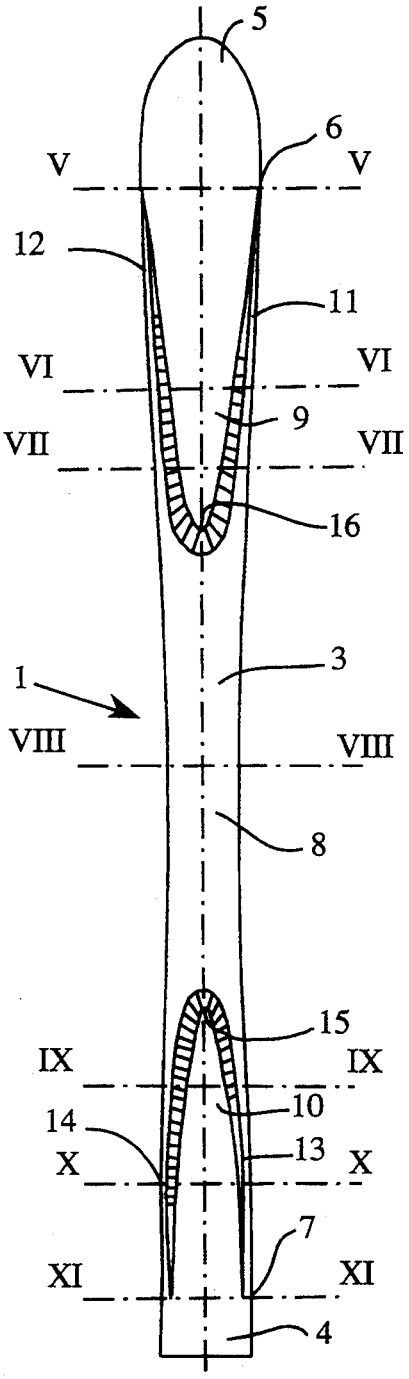
FIG. 2 is a plan view of this ski from the top.
Figure 5:
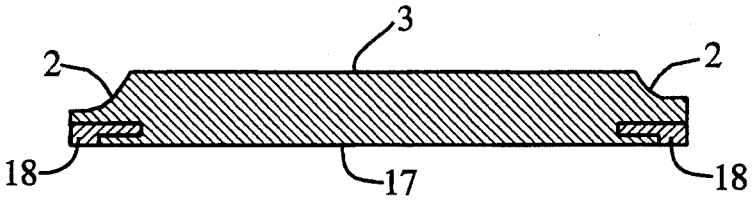
FIGS. 5 to 11 are diagrammatic representations of cross sections of the ski in accordance with the invention, made along the lines represented in FIGS. 2, 3 and 4, and referenced in roman numerals, whose number corresponds to the figure in question.

FIG. 5, corresponding to the cross section along the line V—V in FIG. 2, made in a typical case at the front contact plane (6), shows a traditional ski section, situated at the tip, in which the edges (18) and the bottom (17) of the sole have moreover been represented diagrammatically.

In the following section (FIG. 6) made near the middle of the forward recess (9), the two lateral ribs (11) and (12) are shown, each of the said ribs being limited on the one hand by the side (2) of the ski, and on the other hand by a chamfer (21, 22) as well as the base (19) of the recess (9). There, the bottom of the recess rejoins the normal thickness of the ski, in particular at the front contact line. The depth of the recess here is actually less.

Figure 7:
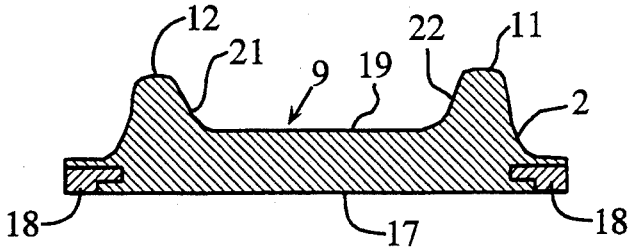

This depth increases in FIG. 7, where the corresponding section is close to the start (16) of the recess (9). The depth is actually much greater, and the two ribs (11) and (12) likewise have higher thickness.

Figure 8:
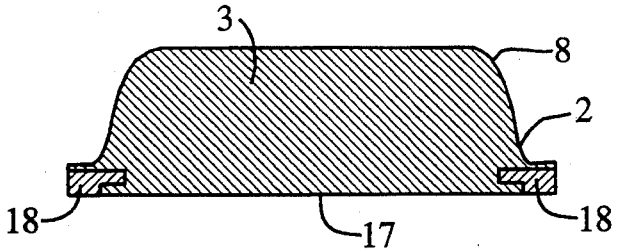

FIG. 8 corresponds to a section made at the zone of the support face (8), which is the zone of maximum thickness intended to accommodate the bindings. In the absence of a recess here, the upper face (3) is planar and parallel to the sole (17).

Figure 6:
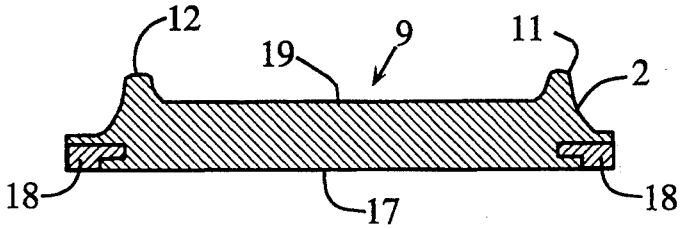
Figure 9:
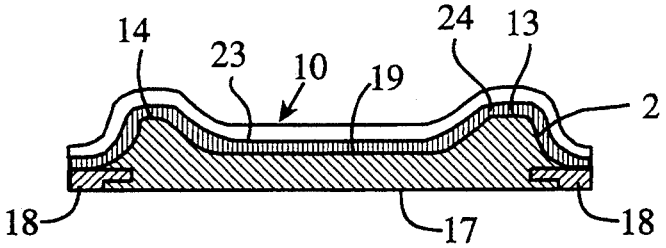
Figure 10:
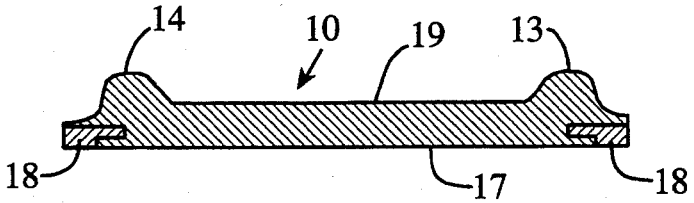

FIGS. 9 and 10 correspond respectively to FIGS. 7 and 6 for the back recess.

Figure 11:
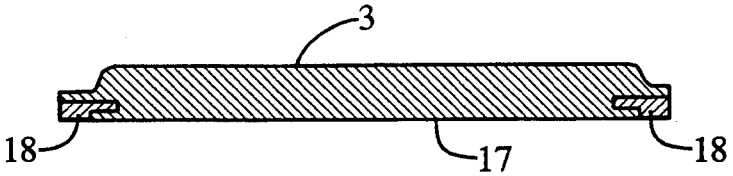

And finally, FIG. 11 corresponds to the rear contact zone, that is say at the start of the rear end, and therefore has a smaller thickness.

In FIGS. 5 to 11, the recesses have been represented symmetrically. Thus, ribs (11, 12) on the one hand, and (13, 14) on the other hand have equal thickness and equal height with respect to the base (19) of the corresponding recesses. Furthermore, the plane formed by the base (19) is parallel to the sole (17), and the slopes (21) and (22) Joining the top of the ribs to the base (19) are also symmetrical with respect to the longitudinal midline of the ski (1).

Figure 12:
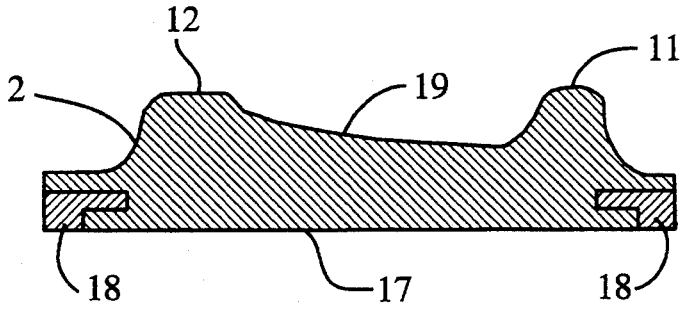
FIGS. 12 and 13 are also cross sections along the line VI—VI in FIG. 2, but of a particular embodiment in accordance with the invention.
Figure 13:
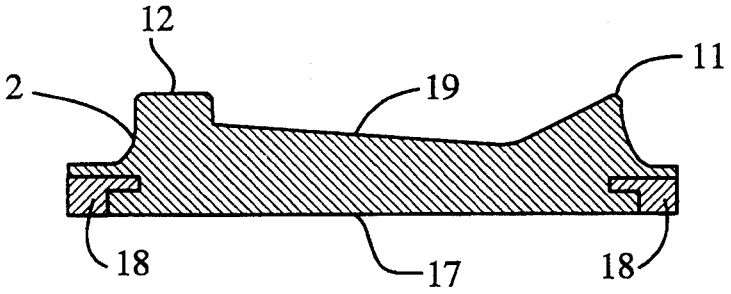

In other embodiments of the invention, asymmetric recesses can also be envisaged, such as represented in FIGS. 12 and 13, in which, on the one hand, the plane formed by the base (19) of the recesses (9) and (10) is not parallel to the sole (17), wherein the ribs themselves also do not have the same thickness and/or the same shape, as particularly represented in FIG. 13.

Figure 14:
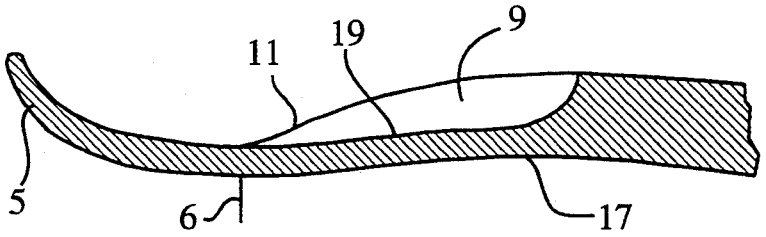
FIGS. 14 and 15 are partial longitudinal sections representing variant embodiments of the front part of a ski according to the invention.
Figure 15:
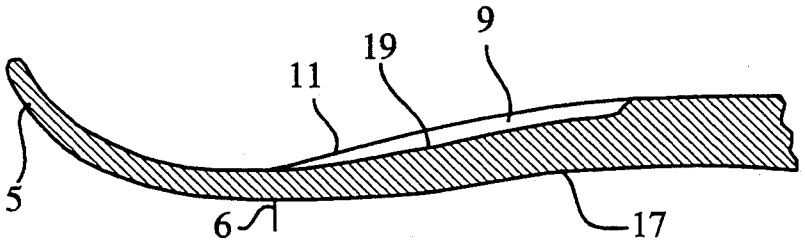

In FIG. 14, the plane of the base (19) is parallel to the sole, whereas in FIG. 15, this base is not parallel to the sole (17). This non-parallelism is longitudinal in FIG. 15, whereas it is transverse in FIGS. 12 and 13.

In this way, skis are obtained which are themselves asymmetrical in particular from the point of view of the distribution of the masses, but also from the point of view of the reinforcement elements, making it possible to distinguish the right ski from the left ski. Each of the two skis forming a pair therefore has particular inertia and resistance to the various bending stresses, leading to different behavior, in particular in turning, thereby optimizing the initiation of the turns and/or the setting of the edges.

Figure 3:
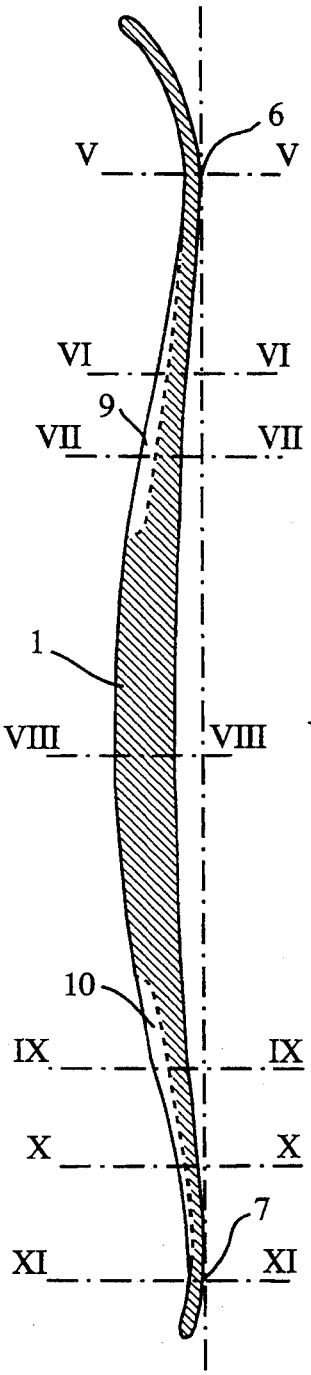
FIG. 3 is a diagrammatic view in longitudinal cross-section along the mid-axis of a first embodiment of the ski.
Figure 4:
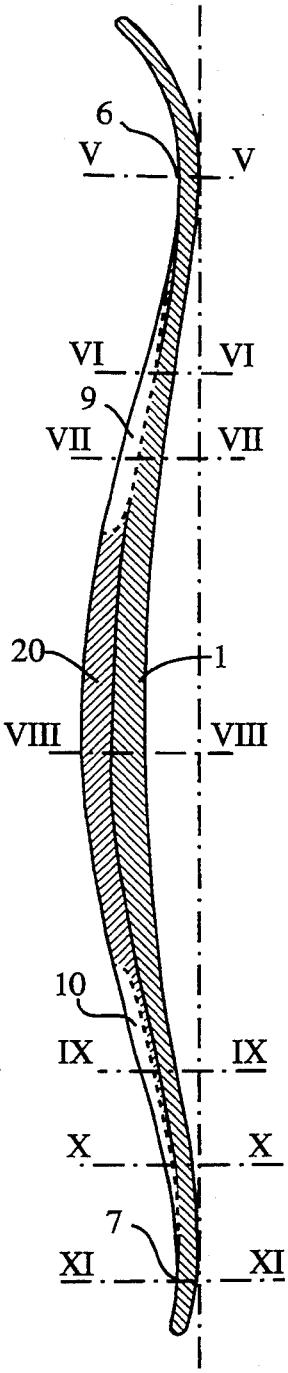
FIG. 4 is a view similar to that in FIG. 3 of a second embodiment of the ski.

A ski in accordance with the invention has been represented in longitudinal section in FIGS. 3 and 4.

Thus, in a first embodiment represented in FIG. 3, the ski in accordance with the invention is obtained directly from molding. The mold has male parts corresponding to the recesses (9) and (10) of the ski. The various elements involved in the construction of the ski, in particular the sole, the lower and upper reinforcement elements and the decoration are fitted in the mold, and the central core is injected, this central core typically being made of polyurethane foam, whose expansion forces the elements to be pressed against the internal walls of the mold, and thereby giving the ski the desired final shape, and in particular the two recesses (9) and (10). That is to say, the ski is obtained in two phases, a first phase of producing the shell by drawing the metal reinforcements, or by thermal forming or premolding of a thermoplastic or heat-setting shell, or one made of fibrous reinforcements, and a second phase of injecting the central core.

In another embodiment represented in FIG. 4, an upper part (20) having the two recesses (9) and (10), these being obtained for example by machining, leaving the ribs (11–14) apparent, is attached onto a conventionally produced ski (1). The part (20) is fixed onto the ski (1), in particular by gluing, either directly, or alternatively through an elastic or viscoelastic film, with the aim of improving its damping properties.

FIG. 9 demonstrates the upper reinforcement element (23) of the ski in accordance with the invention. As already stated, this reinforcement element may consist of a metal alloy, or for example a textile cloth preimpregnated with a heat-setting resin. It is positioned in internal contact with the decorative element (24), and is therefore relatively distant from the neutral axis of the ski. As can be seen in FIG. 9, this reinforcement element has an inverted-Ω shape, in which the wings are spaced apart, and in which the loop adopts the shape of the base (19) of the recess (10). The wings themselves follow the internal shape of the ribs (13, 14). In this way, it is seen that at the zones adjacent to the support face, the ribs being thicker, that the wings of the reinforcement element are longer, thus giving this zone increased resistance to lateral bending forces, in spite of the loss in thickness due to the recess.

Skis thus obtained have very high resistance to lateral bending, in particular because of the lateral wings of the upper Ω-shaped reinforcement element. The increase in depth of the recesses near the zone of the support face further allows the stiffness curve of the ski to be corrected, while decreasing the mass of the ski and retaining at the ends a sufficient mass to give correct inertia and a resistance to the bending forces which is sufficient to allow a ski to be produced with good reaction and responsiveness, and also precision.

Figure 16:
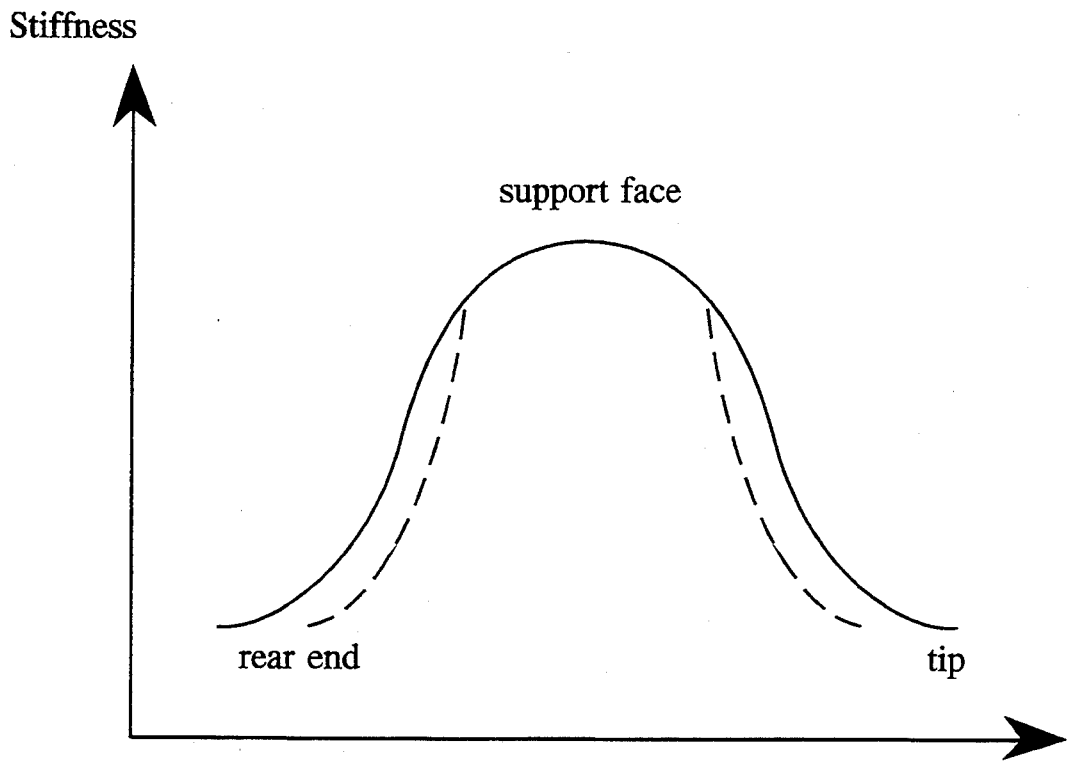
FIG. 16 is graph representing the curve of stiffness of a conventional ski and of a ski in accordance with the invention.

FIG. 16 shows the stiffness curve of a conventional ski, in the unbroken line, and of the ski in accordance with the invention, in which the decrease in the stiffness at the zones adjacent to the zone of the support face, while preserving the requisite stiffness at the ends, is clearly seen.

I claim:

1. A ski comprising:

a running sole extending from a front end to a rear end of said ski;

a continuous upper surface opposing said running sole and extending from said front end to said rear end;

front and rear contact line regions formed proximate said front and rear ends of said ski, respectively;

a central support region formed on said upper surface between said front and rear ends of said ski;

at least one recess formed in said upper surface and extending in at least one of (i) a region forward of said central support region and (ii) a region rearward of said central support region, said at least one recess having a depth which progressively decreases as the recess extends away from said central support region, wherein sidewalls of said at least one recess define ribs on said ski which progressively decrease in lateral thickness as the ribs extend away from said central support region; and at least one reinforcement element provided at least at the location of said at least one recess, said reinforcement element having substantially the same shape as an inverted omega, wherein the loop of the omega corresponds to the base of said at least one recess and the lateral wings of the omega adopt to the shape of said ribs.

2. The ski of claim 1, wherein said at least one recess begins proximate said central support region and ends proximate said contact line region.

3. The ski of claim 1, wherein said at least one recess comprises a recess in said region forward of said central support region and a recess in said region rearward of said central support region.

4. The ski of claim 1, further comprising metal edges on opposite longitudinal sides of said running sole, said metal edges including lateral ridges connected to said upper surface by lateral side walls of said ski.

5. The ski of claim 1, wherein said at least one recess increases in width as the recess extends away from said central support region.

6. The ski of claim 3, wherein said recesses increase in width as the recesses extend away from said central support region.

7. The ski of claim 1, wherein said side walls defining said ribs on said ski decrease in at least one of size and height as the ribs extend away from said central support region.

8. The ski of claim 3, wherein said side walls defining said ribs on said ski decrease in at least one of size and height as the ribs extend away from said central support region.

9. The ski of claim 3 wherein said recesses are symmetrical with respect to a vertical plane extending through the longitudinal midline of said ski.

10. The ski of claim 3, wherein said recesses are asymmetrical with respect to a vertical plane extending through the longitudinal midline of said ski.

11. The ski of claim 3, wherein said recesses are asymmetrical with respect to a vertical plane extending through the transverse midline of said ski.

12. The ski of claim 10, wherein said recesses are asymmetrical with respect to a vertical plane extending through the transverse midline of said ski.

13. The ski of claim 1, wherein a bottom surface of said at least one recess is angled with respect to a plane parallel to said running sole.

14. The ski of claim 3, wherein bottom surfaces of said recesses are angled with respect to a plane parallel to said running sole.

15. The ski of claim 3, wherein said ribs defined by at least one of said recesses are different in shape.

16. The ski of claim 15, wherein said ribs defined by at least one of said recesses are different in at least one of thickness and height.

17. The ski of claim 1, wherein said reinforcement element is situated on at least one side of a neutral axis of said ski.

18. The ski of claim 1, wherein said reinforcement element comprises at least one of a metal alloy and a textile cloth pre-impregnated with a heat-setting resin.

19. The ski of claim 1, wherein said upper surface is attached to said ski by a layer of adhesive.

20. The ski of claim 1, wherein said ski is formed directly by molding.

* * * * *